US005193274A

United States Patent [19]

Ball et al.

[11] Patent Number: 5,193,274

[45] Date of Patent: Mar. 16, 1993

[54] METHOD AND APPARATUS FOR MANUFACTURE OF A VEHICLE WHEEL HAVING CONTROLLED LATERAL RUNOUT CHARACTERISTIC

[75] Inventors: Richard C. Ball, Perry; Anwar R. Daudi, East Lansing; Elvin E. Tuttle, Lansing, all of Mich.

[73] Assignee: Motor Wheel Corporation, Lansing, Mich.

[21] Appl. No.: 825,579

[22] Filed: Jan. 24, 1992

[51] Int. Cl.[5] ..... B23P 19/00; B21K 1/32

[52] U.S. Cl. ..... 29/894.322; 29/802

[58] Field of Search ..... 29/802, 894.32, 894.322

[56] References Cited

U.S. PATENT DOCUMENTS

| | | | |
|---|---|---|---|
| 3,143,377 | 8/1964 | Bulgrin et al. | 29/894.325 |
| 4,279,287 | 7/1981 | Daudi et al. | 29/894.32 |
| 4,354,407 | 10/1982 | Daudi et al. | 29/894.32 |
| 4,646,434 | 3/1987 | Daudi et al. | 29/894.32 |
| 4,733,448 | 3/1988 | Daudi | 29/894.32 |
| 4,736,611 | 4/1988 | Daudi | 29/894.32 |
| 4,815,186 | 3/1989 | Daudi | 29/894.31 |
| 5,029,385 | 7/1991 | Daniels | 29/802 |

*Primary Examiner*—P. W. Echols

*Attorney, Agent, or Firm*—Barnes, Kisselle, Raisch, Choate, Whittemore & Hulbert

[57] ABSTRACT

A method and apparatus for manufacture of a vehicle wheel rim and disc assembly with controlled lateral runout characteristics in which a preformed rim is fixtured and rotated while gauges measure lateral runout of the inboard and outboard rim bead seats. Phase angle and amplitude of the first harmonic of average lateral runout of the bead seats are determined, which effectively identify a rim plane of substantially zero first harmonic of bead seat lateral runout. The wheel disc is fixtured with its mounting surface, defined by the inboard face of the disc, at predetermined orientation with respect to the rim plane of substantially zero first harmonic of bead seat lateral runout, either parallel thereto for a true running wheel or at predetermined angular orientation with respect thereto for placing the high point or low point of the first harmonic of lateral runout of the rim and disc assembly adjacent to a predetermined location circumferentially of the rim. The rim is then assembled to the disc by interference press fit.

17 Claims, 4 Drawing Sheets

METHOD AND APPARATUS FOR MANUFACTURE OF A VEHICLE WHEEL HAVING CONTROLLED LATERAL RUNOUT CHARACTERISTIC

The present invention is directed to the art of vehicle wheel manufacture, and more particularly to control of lateral runout in a vehicle wheel assembly.

BACKGROUND OF THE INVENTION

A problem long-standing in the art lies in the production of pneumatic tire and wheel assemblies that, when assembled and operated on a vehicle, run true about the axis of rotation. Forces generated by circumferential variations in the tire carcass or wheel geometry cause vibrations, which in turn lead to dissatisfied customers and significant warranty claims against automobile manufacturers. The present trend among manufacturers toward higher tire inflation pressures and smaller vehicles to improve fuel economy accentuates this problem, so that rotational uniformity of the tire and wheel assembly has become more critical than in the past.

Rotational non-uniformities in the tire and wheel assembly may possess both radial and axial components. Either or both of such components may be due to manufacturing inaccuracies in the wheel and/or in the tire mounted thereon. Axial characteristics, i.e., runout or force variations in the direction of the wheel and tire axis, are termed "lateral" characteristics in the art and in the present application.

Multipiece vehicle wheels fabricated from metal, usually steel, conventionally include a disc having a circular array of bolt openings adapted to receive mounting studs for mounting the wheel to a vehicle, and a center or pilot opening adapted to be received over the wheel hub. In order to improve radial runout characteristics of the wheel, it has been and remains conventional practice in the wheel manufacturing industry to attempt to form the circle of bolt-mounting openings and the center-pilot opening coaxially with each other and with the rim tire bead seats, with the goal thus being to form a true-running wheel. A number of techniques have been proposed for accomplishing this result, including formation of the bolt and/or center openings while locating off the bead seats, machining the bolt openings while locating off a preformed center openings, and circumferentially permanently deforming the rim bead seats while locating off the bolt-mounting and/or center-pilot openings.

U.S. Pat. Nos. 4,279,287 and 4,354,407, both assigned to the assignee hereof, depart from this conventional practice, and address the problem of radial runout and radial force variations in a pneumatic tire and wheel assembly by intentionally forming the bolt-mounting and/or center-pilot opening in the wheel disc at the time of wheel manufacture on an axis that is eccentrically radially offset from the average axis of the rim bead seats. Such radial offset is in a direction and amount that is predetermined to locate the low point or high point of the first harmonic of bead seat radial runout circumferentially adjacent to a selected location on the wheel rim, such as the rim valve hole. A pretested tire, having the location of the complementary peak of the first harmonic of radial force variation marked thereon, may then be assembled onto the wheel such that the respective tire and wheel harmonics are complementary and thereby tend to cancel each other. U.S. Pat. Nos. 4,736,611 and 4,819,472, assigned to the assignee hereof, disclose an improved technique for forming the bolt-mounting and center-pilot openings in either conventional or styled wheels, which technique may be employed for manufacture of either true-running wheels with minimum radial runout or wheels of controlled eccentricity per the aforementioned patents.

It likewise has been and remains conventional practice in the wheel manufacturing industry to attempt to form true-running wheels of minimum lateral runout—i.e., wherein the mounting plane defined by the inboard surface of the wheel disc in the region of the bolt-mounting openings is parallel to the average plane of the rim bead seats. This is accomplished in accordance with the technique disclosed in Bulgrin et al U.S. Pat. No. 3,143,377, for example, by fixturing a preformed rim on a stationary annular die ring and then press-fitting a preformed disc into the rim, with the axis of press-fit being coincident with the axis of the rim-fixturing ring. Problems with the technique so disclosed are that it does not directly or inferentially employ the average bead seat plane for purposes of fixturing the preformed rim, and that it does not readily accommodate adjustment for different manufacturing runs which may, and usually do, result in differing manufacturing tolerance variations in the rim and disc.

U.S. Pat. Nos. 4,646,434, 4,733,448 and 4,815,186, assigned to the assignee hereof, disclose an apparatus and method for manufacturing a vehicle wheel rim and disc assembly with controlled lateral runout characteristics, as well as a pneumatic tire and wheel assembly having overall improved ride characteristics. The method and apparatus contemplate fixturing a preformed rim so that the average plane of the rim bead seats is at a predetermined orientation with respect to the axis of interference press fit of a preformed disc therewithin, and thus at preselected orientation with respect to the wheel mounting plane defined by the inboard surface of the disc. The average bead seat plane may be nominally parallel to the wheel mounting plane by selective adjustment of the fixturing bead seat locators, so as to minimize lateral runout of the resulting wheel. Alternatively, the average bead seat plane may be intentionally angulated with respect to the disc mounting plane so as to locate a peak of the first harmonic of lateral runout circumferentially adjacent to a selected location on the wheel rim, such as the rim valve hole. In the latter implementation, the wheel so formed may be assembled to a pneumatic tire that is pretested and marked to identify the location of a complementary peak of the first harmonic of lateral force variation, so that the respective harmonics are out of phase and tend to cancel each other, and thereby obtain overall improved ride in the tire and wheel assembly.

OBJECTS AND SUMMARY OF THE INVENTION

It is therefore a general object of the present invention to provide a method and apparatus for manufacturing a vehicle wheel of the described character in which the plane of the wheel mounting surface on the disc is accurately and adjustably positioned with respect to the average bead seat plane. A further and yet more specific object of the invention is to provide an economical and accurate method of assembling a preformed wheel disc to a preformed rim in which the plane of the disc mounting surface is accurately located with respect to the average plane of the rim bead seats, and to provide an apparatus for performing such a method.

Yet another object of the invention is to provide a method and apparatus of the described character in which the plane of the disc mounting surface and the average plane of the rim bead seats are adjustable with respect to each other, so that the method and apparatus of the invention may be implemented in manufacture of true-running wheels wherein the mounting plane and the average bead seat plane are nominally parallel, or in the manufacture of wheels in which the low point or high point of the first harmonic of average bead seat lateral runout (with respect to the disc mounting plane) is angulated by an amount and in a direction predetermined to locate the low point or high point of the first harmonic of bead seat lateral runout circumferentially adjacent to a selected location on the wheel rim, such as the rim valve opening.

In accordance with a first important aspect of the present invention, a method of manufacturing a multipiece vehicle wheel rim and disc assembly comprises the step of providing an annular wheel rim having at least one and preferably two spaced bead seats, and a separate disc having a disc surface that defines the wheel mounting plane. Lateral runout of the rim bead seat(s) is measured, and phase angle and amplitude of the first harmonic of (average) lateral runout of the bead seat(s) is determined so as to identify a rim plane of substantially zero first harmonic of (average) bead seat lateral runout. The rim and disc are then assembled to each other, preferably by interference press fit of the disc within the rim, with the disc surface that defines the wheel mounting plane at predetermined orientation with respect to the rim plane of substantially zero first harmonic of bead seat lateral runout. For a true-running wheel, the disc mounting surface is nominally parallel to the rim plane of substantially zero first harmonic. For manufacture of a wheel having a first harmonic of lateral runout of controlled magnitude and location, the disc mounting surface is oriented with respect to the rim plane of substantially zero first harmonic of bead seat lateral runout so as to obtain a first harmonic of lateral runout of desired magnitude, and to orient the high point or low point of the first harmonic of lateral runout at preselected position circumferentially of the rim.

Apparatus for constructing a multipiece vehicle wheel rim and disc assembly in accordance with another aspect of the present invention includes a table having a surface for receiving and supporting a preformed rim and for rotating the rim about a fixed axis. Sensors engage the rim bead seats while the rim is rotated on the table to provide electrical sensor signals as respective functions of lateral runout of the rim bead seats. (Radial runout may also be measured at this point for quality control or other purposes. Use of multiple sensors would eliminate the necessity of rotating the rim.) The sensors are coupled to suitable electronics responsive to the sensor signals for computing the phase angle and amplitude of the first harmonic of average lateral runout of the rim bead seats, and thereby identifying an average rim bead seat plane of substantially zero first harmonic of lateral runout. A preformed disc is clamped with the wheel mounting surface defined by the disc against a plate that intersects the axis of table rotation. The plate is adjustably mounted with respect to its support for adjusting the orientation of the disc mounting surface with respect to the axis of rim rotation. The table is then moved toward the plate so as to press or otherwise assemble the rim over the periphery of the disc while the disc remains in stationary position with its mounting surface at controlled orientation with respect to the rim.

BRIEF DESCRIPTION OF THE DRAWINGS

The invention, together with additional objects, features and advantages thereof, will be best understood from the following description, the appended claims and the accompanying drawings in which:

DETAILED DESCRIPTION OF PREFERRED EMBODIMENTS

Figure 1:
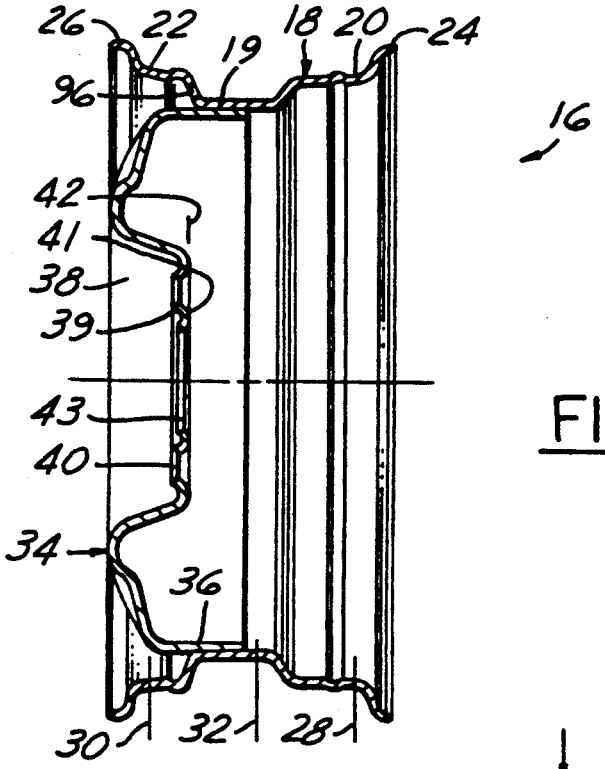
FIG. 1 is a sectional view of a vehicle wheel taken on a radial plane that intersects the wheel axis.

FIG. 1 illustrates a two-piece fabricated steel vehicle wheel 16 as including a one-piece drop-center wheel rim 18 having a rim base 19, and inboard and outboard circumferential bead seats 20,22 for receiving respective inboard and outboard bead toes of a tire mounted on rim 18 in the usual manner. Bead seats 20,22 include the usual bead retaining flanges 24,26 respectively. Each bead seat 20,22 may be considered conceptually to lie in or define an associated average bead seat plane 28,30, which in theory are parallel to each other, but may not be parallel in practice due to manufacturing variations and tolerances. Bead seat planes 28,30 together define a composite average bead seat plane 32. The orientations of the individual average bead seat planes 28,30, as well as the location and orientation of the composite average bead seat plane 32, may be determined using conventional Fourier analysis techniques.

A wheel mounting disc 34 includes a peripheral flange 36 press fitted into and welded to rim base 19, and a disc body that internally spans rim 18 for mounting wheel 16 to a vehicle. Bolt openings 40 are formed in a circular array, one in each of the slightly raised bolt-hole embossments 39. A center or pilot opening 43 is positioned within the array of bolt openings 40. The inboard surface of disc body 38 in the region of bolt openings 40 defines a wheel mounting surface 41, having an average plane 42, that engages the wheel mounting surface of a wheel hub (or brake rotor or drum) spindle when the wheel is bolted thereto.

As is understood in the art, the relationship of individual average bead seat planes 28,30 to each other and to disc mounting plane 42 controls lateral runout characteristics of wheel 16. The relationship of bead seat planes 28,30 to each other is determined during preforming of rim 18. The present invention addresses the relationship of disc mounting plane 42 to individual average bead seat planes 28,30 (and composite average bead seat plane 32). It has become conventional practice in recent years to preform rim 18 and disc 34, with the configuration of FIG. 1 being exemplary, and to join the rim to the disc prior to formation of bolt-mounting and center-pilot openings 40,43 in the disc body. Indeed, various U.S. patents assigned to the assignee hereof and identified hereinabove disclose methods and apparatus for performing such bolt-mounting and center-pilot openings in a preassembled rim and disc assembly. The present invention is directed to assembly of a preformed disc 34 to a preformed rim 18, preferably prior to formation of the bolt-mounting and center-pilot openings in the disc body in accordance with the teachings of the above-noted U.S. patents. It is to be understood, however, that it is within the scope of the invention to employ a disc body having the bolt-mounting and/or center-pilot opening formed therein prior to assembly to the rim.

Figure 2:
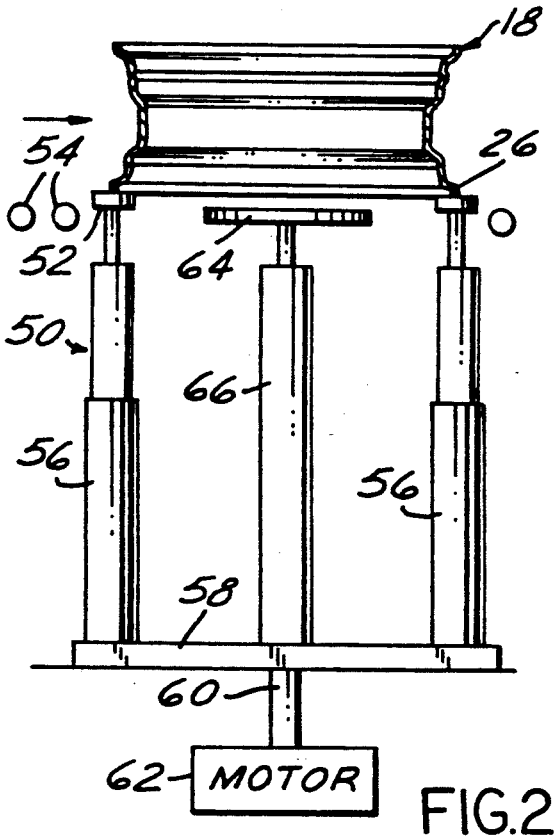
FIGS. 2–7 are schematic diagrams that illustrate a presently preferred embodiment of wheel assembly apparatus and method in accordance with the present invention at successive stages of operation.
Figure 3:
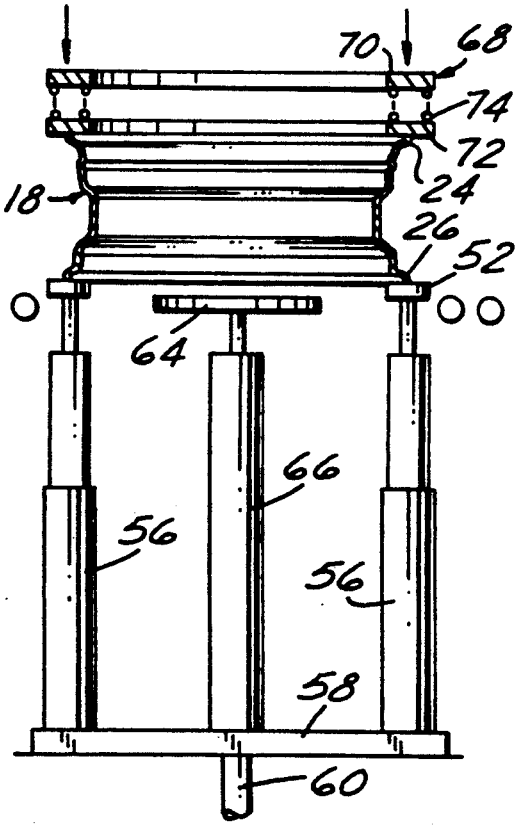

FIGS. 2–8 collectively illustrate an exemplary but presently preferred apparatus 50 in accordance with the present invention for interference press-fit assembly of a preformed disc 34 and a preformed rim 18. Apparatus 50 comprises an annular table 52 positioned adjacent to a conveyor line 54 to receive and support the outboard bead seat flange 26 of a preformed rim 18. Table 52 is supported by a circumferential array of actuators 56, which in turn are carried by a support base 58 that is coupled by a shaft 60 to a motor 62 for rotation of table 52 about the fixed axis of shaft 60. A disc clamp plate 64 is mounted by an actuator 66 on support base 58 coaxially with shaft 60, and thus coaxially with the axis of rotation of support base 58 and annular table 52. As best seen in FIGS. 2–3, clamp plate 64, in the fully retracted condition of actuator 66, is positioned at or below the rim-support plane of table 52.

A rim clamp ring 68 (FIGS. 3–7) is positioned above and opposed to the upper rim-supporting surface of annular table 52. Ring 68 includes a pair of ring segments 70,72 spaced from each other by an array of coil springs 74. Upper ring segment 70 is coupled to a suitable drive device 76 (FIG. 8) for moving clamp ring 68 toward and away from table 52. The diameter of clamp 68 is such as to engage the inboard bead flange 24 of a rim 18 supported on table 52 and resiliently hold rim 18 on table 52. Clamp ring 68 is free to rotate about the axis of shaft 60 with table 52 and wheel rim 18 clamped therebetween.

Positioned above table 52 and conveyor 54 coaxially with shaft 60 is a fixed support 80. Support 80 carries three servo motors 82 (or two servo motors and one fixed pivot) that are disposed at 120° spacing around the axis of shaft 60. A flat plate 84 is suspended by three lead screws 86 from the three servo motors 82. Lead screws 86 are coupled to plate 84 by suitable swivel couplings (not shown). Thus, angle of the planar lower surface 88 of plate 84 is determined and controlled by lead screws 86 and servo motors 82. A pair of gauges 90 (FIG. 5) are supported (by means not shown) above table 52 in the position illustrated in FIGS. 2–5, and are coupled to suitable drive mechanisms 92 (FIG. 8) for moving gauges 90 into and out of engagement with the bead seats 20,22 of a rim 18 carried by table 52 in the lower position of the latter. Gauges 90 include suitable sensors for providing electrical signals to a central controller 94 (FIG. 8) as a function of lateral runout at the respective bead seats.

Figure 5:
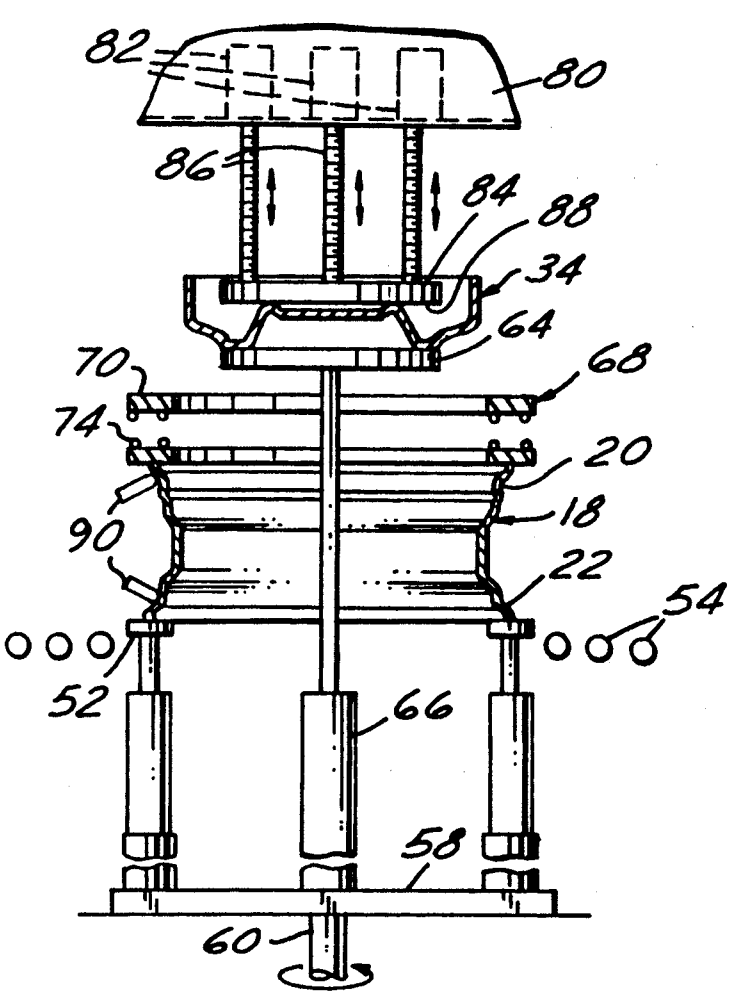
Figure 4:
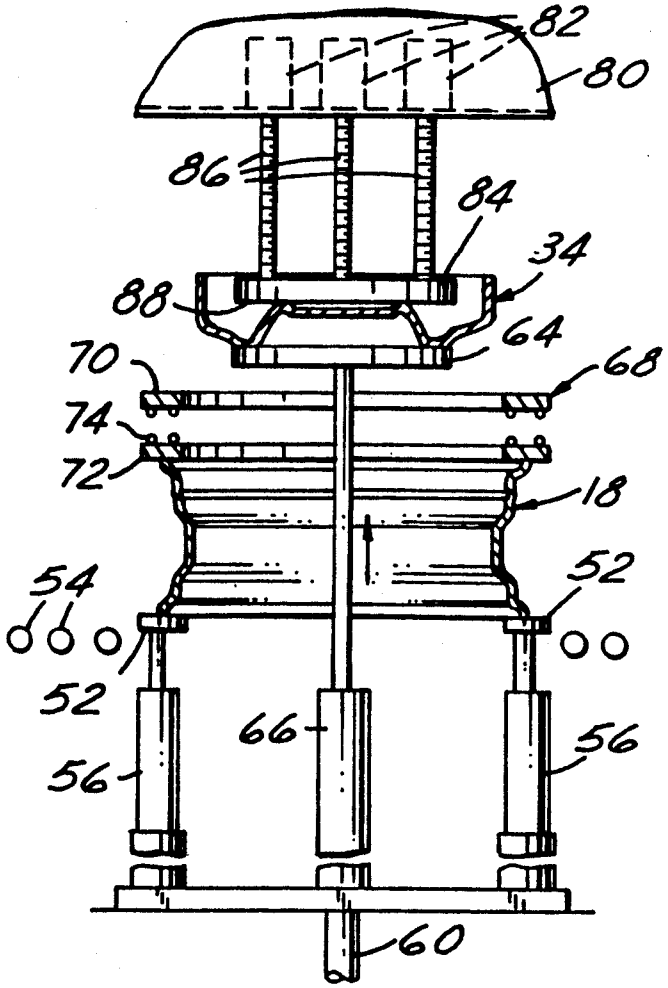
Figure 7:
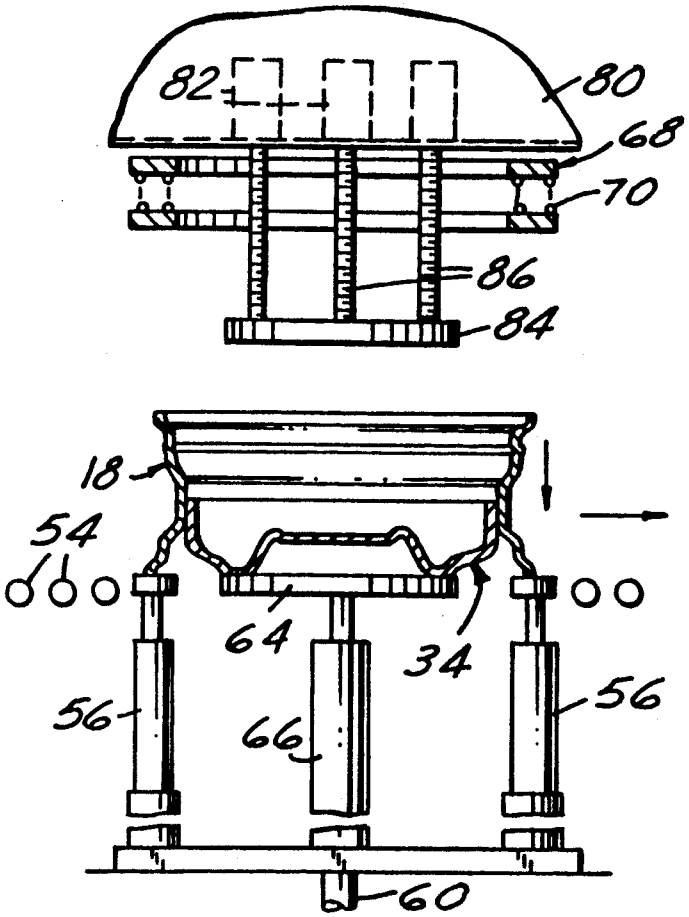
Figure 6:
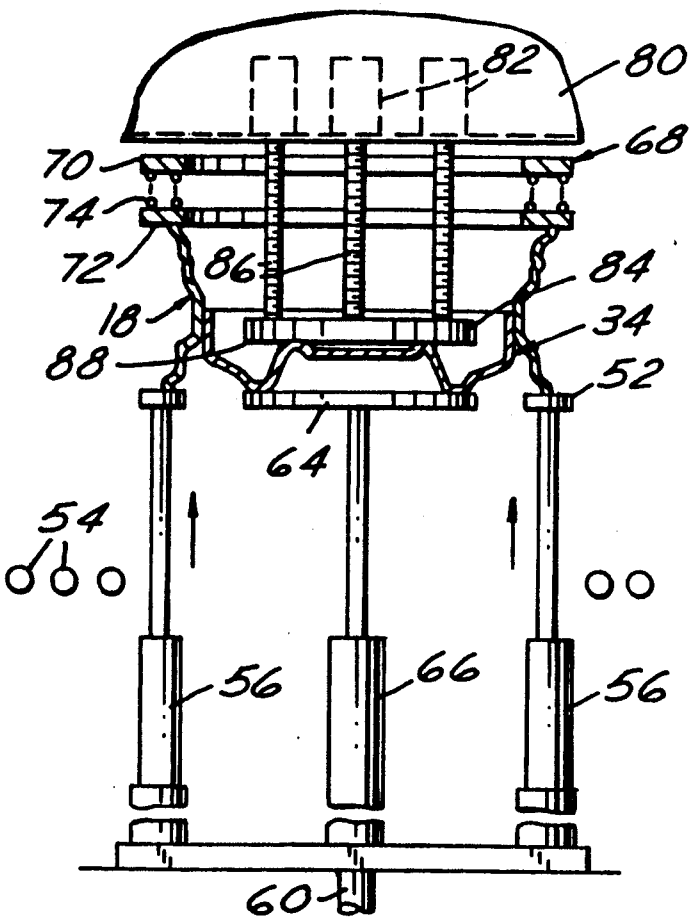
Figure 8:
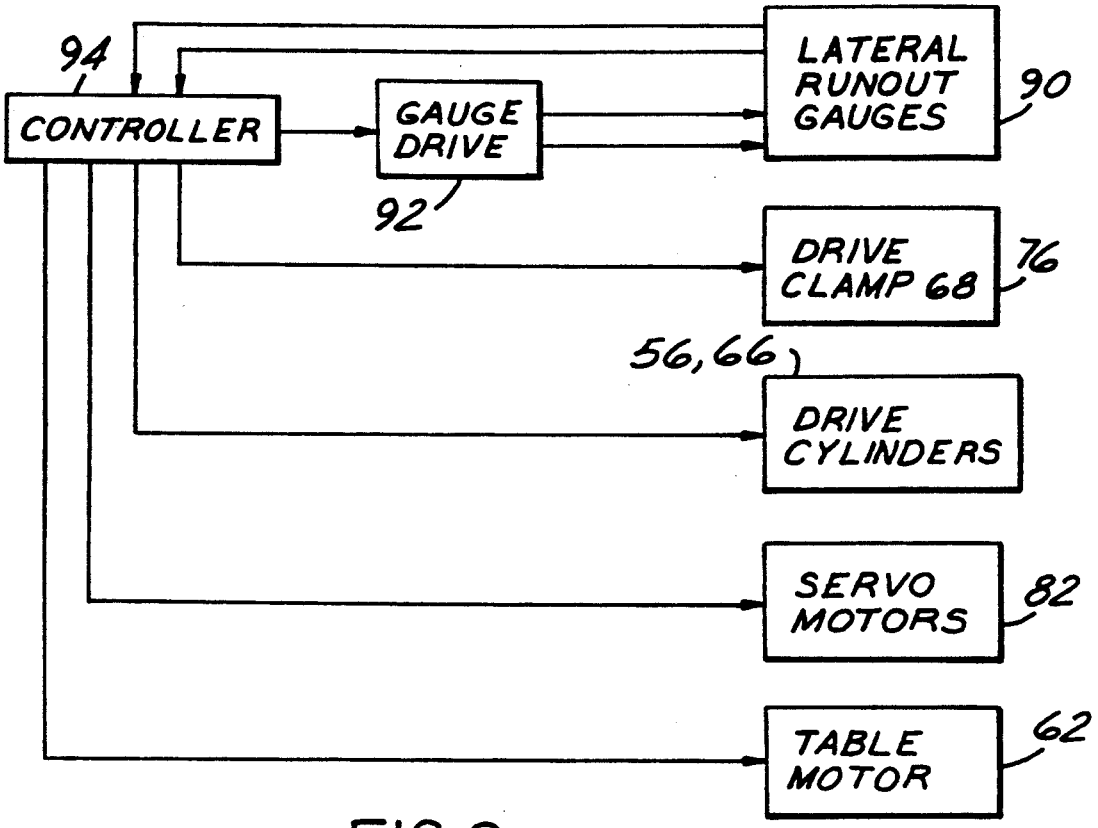
FIG. 8 is a functional block diagram of the apparatus control electronics.

In operation, a wheel rim 18 is first received along conveyor 54 (FIG. 2), and is positioned on table 52 with the outboard bead seat flange 26 resting thereon. Clamp ring 68 is then lowered, as shown in FIG. 3, under control of controller 94 (FIG. 8). Disc clamp plate 64 is then elevated by ram 66 from the FIG. 3 to the FIG. 4 position, and then disc 34 is positioned on plate 64 and then clamped between plate 64 and plate 84, as shown in FIG. 4, with the mounting surface 41 of disc 34 in abutting engagement with the surface 88 of plate 84. (Disc 34 may be manually or automatically loaded, or may be loosely carried on rim 18 and picked up by extension of ram 66.) With the disc and rim so positioned, gauges 90 are brought into engagement with bead seats 20,22 as shown in FIG. 5, and table motor 62 (FIGS. 2 and 8) is energized by controller 94 to rotate support 58 and table 52 about the axis of shaft 60. With the wheel rim so rotating and gauges 90 in engagement with the bead seats, lateral runout measurements are taken at equally spaced intervals of wheel rim rotation. Preferably, the readings are taken simultaneously at the two gauge sensors, and are averaged, with the average of each pair of readings being stored in the memory of controller 94. (Individual readings and calculations may also be obtained, if desired.) Following a full 360° of rotation of the wheel rim, controller 94 computes at least the first harmonic of average lateral runout of the bead seats using conventional Fourier analysis techniques. The result of this computation is the phase angle and amplitude of the first harmonic of average lateral runout of the rim bead seats, which in turn identifies a rim plane of substantially zero first harmonic of bead seat lateral runout. It is to be noted that rim 18 and bead seats 20,22 need not be precisely centered about the axis of rotation of shaft 60, although substantial centering is desirable.

Preferably, the rim and disc are each oriented at this stage of operation. That is, one or more pilots and/or pins (not shown) on plate 64 engages corresponding openings in disc 34 so as to orient the disc circumferentially of ram 66. In the same way, the rim valve stem opening or other suitable means on rim 18 is employed to orient the rim circumferentially with respect to the disc so that the weld that joins the disc to the rim does not extend into the rim butt weld.

After the rim plane of substantially zero first harmonic of bead seat lateral runout has been found, servo motors 82 (FIGS. 5 and 8) are energized by controller 94 so as to orient planar surface 88 of plate 84 at predetermined orientation with respect to the average first harmonic plane of rim 18. For a "true running" wheel, the planar surface 88 is oriented parallel to the plane of the first harmonic of lateral runout. On the other hand, for forming a wheel with controlled lateral harmonic for match mounting with a tire, planar surface 88 of plate 84 is oriented at a predetermined angle with respect to the average first harmonic plane of rim 18, which is oriented in a predetermined direction, so as to place the low point or high point of the first harmonic of average lateral runout at some predetermined location circumferentially of the wheel rim, such as at the rim valve hole 96 (FIG. 1). In this respect, table motor 62 continues to rotate rim 18 until rim valve hole 96 is at some predetermined orientation with respect to disc 34 carried by plate 64. Table 52 is then raised by actuators 56, while disc 34 is clamped in fixed position between plates 64,84, so as to press rim 18 upwardly over the periphery of disc 34. The rim and disc assembly, which are now temporarily held in assembled relation by the press fit of the disc within the rim, is then lowered by lowering of table 52 and plate 64 (FIG. 6 to FIG. 7), and the rim and disc assembly is transferred by conveyor 54 to subsequent manufacturing stages for welding or otherwise permanently affixing the disc within the rim, forming the bolt and center openings in the disc, painting the completed wheel assembly, etc.

Figure 9:
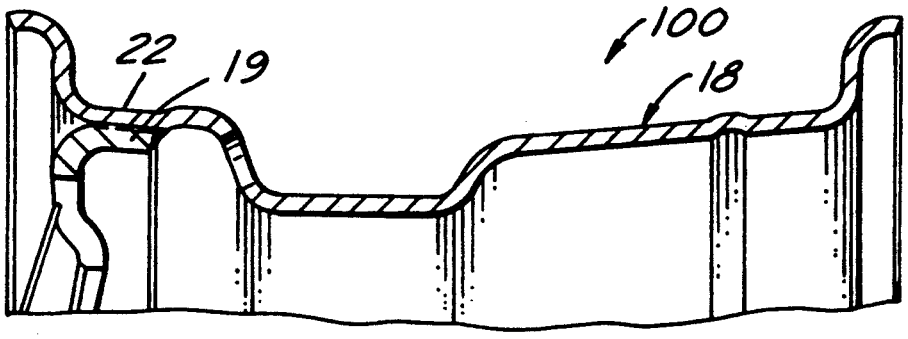
FIGS. 9 and 10 are fragmentary sectional views that illustrate other wheel constructions that may be provided in accordance with the present invention.

FIG. 9 illustrates a wheel assembly 100 in which the disc flange 22 is press fitted and welded to the weather side of the outboard bead seat 22 rather than the rim drop well as in FIG. 1. The wheel construction of FIG. 9 is particularly well suited for front wheel drive vehicles requiring high offset between rim midplane 32 and disc mounting surface 42.

Figure 10:
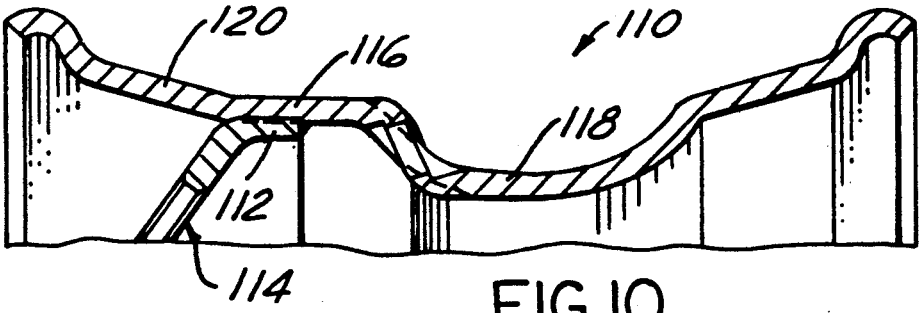

FIG. 10 illustrates a truck-type wheel construction 110 in which the disc flange 112 of a deeply dished disc 114 is press fitted and welded to the weather side of a rim ledge 116 between the drop well 118 and the outboard bead seat 120. The present invention is thus by no means limited to specific details of the wheel constructions illustrated in FIGS. 1, 9 and 10.

As previously indicated, it is presently envisioned that the subject matter of the present invention be combined with—i.e., used in combination with—the subject matters of the previously noted U.S. patents assigned to the assignee hereof to obtain a wheel, and a tire and wheel assembly, having improved ride characteristics in terms of both lateral and radial ride components. It has been found that lateral variations, due to lateral runout of the wheel and lateral force variations of the tire, produce less undesirable ride characteristics as compared to radial runout and force variations, particularly when the lateral ride variations are held below a threshold level. It has also been found to be extremely difficult, employing present technology, to control both lateral and radial runout of a wheel simultaneously, and lateral and radial force variations of a tire simultaneously, so that both respective harmonics can be made to cancel. It is therefore presently preferred to construct a wheel to possess minimum lateral runout by locating the average bead seat plane 32 (FIG. 1) parallel to the wheel mounting plane 42 in accordance with the principles of the present invention, and to form the bolt and center-pilot openings of the wheel disc in a subsequent stage of manufacture so as to locate a peak of the first harmonic of radial runout adjacent to the valve hole, as described in the referenced patents.

We claim:

1. A method of manufacturing a vehicle wheel rim and disc assembly that includes an annular rim and a disc carried within said rim, said method comprising the steps of:

(a) providing a wheel rim having at least one bead seat and a separate disc having a disc surface that defines a wheel mounting plane, (b) measuring lateral runout of said at least one bead seat and determining phase angle and amplitude of the first harmonic of lateral runout of said bead seat so as to identify a rim plane of substantially zero first harmonic of bead seat lateral runout, and then (c) assembling said disc to said rim with said disc surface at predetermined orientation with respect to said rim plane.

2. The method set forth in claim 1 wherein said step (b) is carried out by:

(b1) rotating said rim about a predefined axis while engaging said bead seat with lateral runout sensing means, and (b2) determining lateral runout of said bead seat as a function of an output of said sensing means.

3. The method set forth in claim 1 wherein said step (c) is carried out by:

(c1) clamping said disc with said disc surface against a flat plate, and (c2) press fitting said rim and disc together.

4. The method set forth in claim 3 wherein said step (c2) comprises the step of press fitting said rim onto said disc while holding said disc in stationary position.

5. The method set forth in claim 4 wherein said step (c) comprises the additional step, prior to said step (c2), of: adjusting said flat plate such that said disc surface is at said predetermined orientation with respect to said rim.

6. The method set forth in claim 1 wherein said step (a) comprises the step of providing said rim having a pair of axially spaced bead seats, and wherein said step (b) comprises the step of determining phase angle and amplitude of average lateral runout of said bead seats so as to identify said rim plane of zero first harmonic of average bead seat lateral runout.

7. Apparatus for constructing a vehicle wheel rim and disc assembly that includes a preformed annular rim having at least one rim bead seat and a preformed disc having a surface that defines a wheel mounting plane, said apparatus comprising:

first means including means forming a first surface for receiving and supporting a preformed rim, sensing means for engaging the bead seat of the rim on said first means to provide an electrical sensor signal as a function of lateral runout of the rim bead seat, means coupled to said sensing means and responsive to said signal for determining a rim bead seat plane of substantially zero first harmonic of lateral runout, second means forming a second surface on a fixed axis, means for clamping a preformed disc with said disc surface against said second surface, one of said first and second means including means for adjusting orientation of one of said first and second surfaces with respect to said axis, and means for moving one of said first and second means with respect to the other so as to fit the disc clamped against said second surface within the rim carried by said first surface.

8. The apparatus set forth in claim 7 wherein said means for moving one of said first and second means moves the one of said first and second means other than the one that includes said surface orientation-adjusting means.

9. The apparatus set forth in claim 7 wherein said second means comprises a flat plate having said second surface for engaging said disc surface, and means for adjustably positioning said plate with respect to said axis.

10. The apparatus set forth in claim 9 wherein said second means further comprises a support, and wherein said adjustably-positioning means comprises means adjustably mounting said plate to said support.

11. The apparatus set forth in claim 10 wherein said adjustably-positioning means comprises a plurality of lead screws coupled to said plate and surrounding said axis, and a plurality of motor drive means carried by said support and coupled to said lead screws.

12. The apparatus set forth in claim 7 wherein said first means comprises an annular table surrounding said axis having said first surface for receiving and supporting said rim.

13. The apparatus set forth in claim 12 further comprising means for clamping said rim against said annular table.

14. The apparatus set forth in claim 12 wherein said second means comprises clamp means positioned within said table, and means for moving said clamp means between a first position extending through said table to clamp the disc against said second surface and a second position spaced from said second surface by a distance sufficient to permit placement of the rim onto said first surface.

15. The apparatus set forth in claim 14 wherein said first and second surfaces are opposed to each other along said axis.

16. The apparatus set forth in claim 7 for constructing a wheel having a rim with a pair of spaced bead seats wherein said sensing means includes first and second sensing means for respectively engaging said bead seats and providing electrical signals as a function of lateral runout thereof, and wherein said means for determining said rim bead seat plane comprises means for determining said plane as a function of lateral runout of said bead seats measured simultaneously.

17. The apparatus set forth in claim 16 wherein said first means includes means for rotating a rim on said first surface about said fixed axis.

* * * * *